US007748149B1

(12) United States Patent
Reavis

(10) Patent No.: US 7,748,149 B1
(45) Date of Patent: Jul. 6, 2010

(54) ILLUMINATED DISPENSER AND DISPLAY FOR ADVERTISEMENTS

(76) Inventor: Jeff Reavis, 302 Wiget La., Walnut Creek, CA (US) 94598

( * ) Notice: Subject to any disclaimer, the term of this patent is extended or adjusted under 35 U.S.C. 154(b) by 0 days.

(21) Appl. No.: 11/894,898

(22) Filed: Aug. 21, 2007

Related U.S. Application Data

(60) Provisional application No. 60/839,257, filed on Aug. 22, 2006.

(51) Int. Cl.
*G09F 23/00* (2006.01)

(52) U.S. Cl. ..... 40/566; 312/102; 40/606.06

(58) Field of Classification Search ..... 40/566
See application file for complete search history.

(56) References Cited

U.S. PATENT DOCUMENTS 5,309,656 A * 5/1994 Montgomery ..... 40/442
5,522,540 A * 6/1996 Surman ..... 232/17
6,263,601 B1 * 7/2001 Emert ..... 40/564
6,719,193 B2 * 4/2004 Katulka ..... 232/38

* cited by examiner

*Primary Examiner*—Joanne Silbermann

(57) ABSTRACT

An illuminated dispenser and display apparatus for advertisements provides a solar powered display box for real estate flyers or brochures. The box includes a back panel, two side panels, a transparent front panel, a bottom, and a hinged lid or top panel so that a person can lift the lid open and remove a brochure. An internal bright white LED illuminates the front panel and the contents of the box. Power is supplied by an internal rechargeable battery, recharged by a solar panel mounted on the top of the hinged lid. A photo sensor activates the LED during low light conditions. An optional feature provides the inside wall of the back panel with one or a plurality of shelves or detents to accommodate information-bearing cards, such as business cards.

3 Claims, 2 Drawing Sheets

ILLUMINATED DISPENSER AND DISPLAY FOR ADVERTISEMENTS

CROSS REFERENCE TO RELATED APPLICATIONS

The present application claims the benefit of the filing date of U.S. Provisional Patent Application Ser. No. 60/839,257, filed 22 Aug. 2006.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention relates generally to signs and advertisements, and more particularly to improved dispensers and displays for advertisements and the like.

BACKGROUND INFORMATION AND DISCUSSION OF RELATED ART

U.S. Pat. No. 4,319,310 to Kingsley discloses self-contained solar signs utilizing incident solar energy employing solar cells or thermal absorbers for generating electricity which is stored and later used for energizing sign illuminating lamp or lamps.

U.S. Pat. No. 4,484,104 to O'Brien describes a solar-powered lighting system suitable for signs or hoardings, navigation beacons or as an emergency supply for hotels, cinemas, hospitals or other services. The system incorporates solar cell arrays which generate electricity which is stored in batteries. A sensing circuit selectively connects the batteries to lights. A timing/switching circuit may be provided to selectively connect the lights to a main supply.

U.S. Pat. No. 4,718,185 to Conlin, et al. teaches a modular solar generating system. The system includes a plurality of self-contained solar modules which are interconnectedly disposed in an array about the perimeter of a rigid framework housing a sign, light, or other load means necessitating electrical power during the night time hours. The modules themselves consist of a photovoltaic plate sandwiched between two suitable cover plates, including in this arrangement one or more continuous conductors. The modules are linked together by way of male and female plug connectors whereby the array may then be electrically connected to a battery. When the modular system is arranged in this fashion and exposed to incident sunlight for an appropriate period of time, power may be provided to a sign, light or other electrical apparatus for nighttime use.

U.S. Pat. No. 5,101,329 to Doyle discloses a realty sign lighting and display assembly including a generally inverted U-shaped housing which fits over the horizontal arm of a realty sign, a lock releasably holding the bracket to the arm, with or without springs spacing the bracket from the arm. The solar panel is connected to a storage battery, in turn connected to lights, all borne by the light assembly which also carries a light-responsive switch and timer so that the lights operate only at a suitable low light level. The assembly can be provided in kit form or fully connected together, is light in weight and is fully portable and efficient.

U.S. Pat. No. 5,309,656 to Montgomery describes a flashing advertising sign for indoor use. The sign is of box-like transparent construction having parallel front and rear panels and elongated upper and lower panels having facing retaining channels which slidably secure a flat placard. Photovoltaic cells positioned in the upper panel supply energy to a rechargeable storage battery. A timing circuit periodically directs electrical current from the battery to light-emitting diodes which illuminate the placard.

U.S. Pat. No. 5,435,087 to Karkar, et al. teaches a solar powered display device comprising a housing, a generally transparent cover, a solar panel disposed within the housing in planar parallel position with respect to the transparent cover, a battery disposed within the housing and electrically interconnected with the solar panel so as to facilitate charging of the battery via the solar panel, and an illuminator disposed within the housing so as to illuminate display indicia, the illuminator being in electrical communication with the solar panel and the battery so as to receive electrical power therefrom. The display indicia are formed upon plates removably disposed within the housing in planar parallel position with respect to the transparent cover, each plate preferably having a character or the like formed thereupon. A rack is configured to hold plates of a plurality of different sizes.

U.S. Pat. No. 5,460,325 to Surman discloses a solar lit illuminated address number and mailbox structure comprising an open topped tray structure, a mailbox, a pivot pivotally connecting the mailbox to the open topped tray structure, a solar energy collector structure exteriorly mounted on the mailbox, a circuit operatively connected to the solar energy collector structure mounted in the tray structure including a battery, and an address number light display mounted on an exterior surface of the mailbox electrically connected with the circuit and powered by the battery, the solar energy collector providing a power source and connected through the circuit to charge the battery, the mailbox structure being pivotal on the pivot to expose the circuit stored in the open topped tray structure.

U.S. Pat. No. 5,467,076 to Ruocco, et al. describes a realty sign lighting/anti-theft assembly. The assembly is in the form of a real estate standard having a vertical post and a horizontal cross-arm from which depends a display panel. The cross-arm is specially constructed to incorporate within it anti-theft and display components and components for powering the anti-theft display components. Thus, the cross-arm includes a solar panel, preferably at the top of the cross-arm, and a rechargeable battery connected to the solar panel. The battery powers one or more spot lights located in the bottom of the cross-arm and directed at the display panel below the cross-arm. The solar panel includes electrical heating elements which keep the solar panel free of snow. A thermal sensor may be disposed in the top of the cross-arm and be connected to a switch operating the solar panel. An alarm connected to the battery prevents theft of the cross-arm. Preferably, the alarm includes a pendulum switch activatable by moving the cross-arm. The switch may be connected to a programmable coder. The cross-arm also includes a continuous advertising tape broadcast by a radio transmitter in the cross-arm. A door bearing a lock in the cross-arm provides access to the components in the cross-arm.

U.S. Pat. No. 5,522,540 to Surman teaches a solar powered illuminated address number and mailbox structure comprising a tray structure, a mailbox, a solar energy collector structure exteriorly mounted on the mailbox, a circuit operatively connected to the solar energy collector structure mounted in the tray structure including a battery, and an address number light display mounted on an exterior surface of the mailbox, the solar energy collector providing a power source and connected through the circuit to charge the battery, the address number light display comprising a lighting means, an address display frame, a transparent display device, and reflective address numerals, the lighting means being attached to an exterior surface of the mailbox and being electrically connected with the circuit means and powered by the battery, the address display frame having a fastening means for securing the address display frame to an exterior surface of the mailbox, the reflective address numerals being attached to a back side of the transparent display device adjacent to the exterior surface of the mailbox, the transparent display device having a reflective tape attached along polished edges on the transparent display device leaving a small light opening on one edge, the lighting means being positioned adjacent a polished edge of the transparent display device such that light transmitted from the lighting means is directed through the small light opening on the transparent display device, whereby substantially all of the light entering the transparent display device will reflect within the transparent display device off of the reflective tape attached along the polished edges and the reflective address numerals thereby resulting in an unusually brilliant even display of the reflective address numerals.

U.S. Pat. No. 5,570,000 to Kowalski discloses a solar powered light fixture including a lighting assembly for directing light downward onto a surface, the assembly including a shield having two attached plates disposed in angled relation to each other and adapted for mounting above the lighted surface. A solar panel is mounted on the top surface of the shield to convert light energy into electric power for recharging the battery. A photocell is mounted on the top surface of the shield to measure the ambient light and provide the source for switching between the charging and lighting modes.

U.S. Pat. No. 5,729,924 to Reading describes an illuminating sign assembly includes a sign housing for receiving and supporting a sign, and a bulb located within the housing which automatically activates to illuminate the sign at night. A rechargeable battery is connected to the bulb for supplying an operating electrical current to the bulb. A solar cell is connected to the battery, and operates to convert light to electrical energy to be stored in the battery for discharge to the bulb.

U.S. Pat. No. 5,920,634 to Chiquette teaches an audio advertising display standard for use as a placard, real estate sale/lease advertising standard, or other advertising uses, that supports a visual display panel and provides auditory information about a property, place of business, event, exhibit, or object upon activation by an attendant listener. The advertising standard preferably comprises a combination of a hollow post and orthogonal arm, means for supporting a display panel, means for playing back a prerecorded audio message whenever activated including a speaker mounted on the post or arm, and a publicly accessible means for activating the play back means. The display standard of the present invention may further include means for recording an audio message for subsequent play back including a microphone, means for activating the recording means, and/or means for illuminating the display panel supported by the standard. The audio message is preferably stored on an integrated chip but can be held on a tape, disk, or other sound recording storage device.

U.S. Pat. No. 6,004,002 to Giannone discloses an improved solar lighting system can be applied to a number of temporary signs and is particularly adapted for use on a real estate sign. The system includes three parts: a solar generating unit containing a repositionable array or photovoltaic cells, electronic circuitry and storage batteries; an illumination unit containing electric lamps and reflectors and attachment devices for connection to a variety of signs; and a connecting cable for safely conducting electric energy between the units and for providing device security to discourage theft.

U.S. Pat. No. 6,131,321 to Daigle, Jr. describes a solar lighting system and method which is especially useful for street and address signs. An upper unit contains a solar energy collector, a storage battery and a light sensor to turn the light on and off as needed. A system to bypass the light sensor control includes a radio frequency(RF) radio receiver which responds to a transmitter. The lighting unit may be economically manufactured and installed on new or existing lighting fixtures.

U.S. Pat. No. 6,263,601 to Emert teaches a lighted real estate sign having at least one translucent face with indicia to convey marketing information pertaining to a parcel of real estate. An internal light illuminates the translucent face and clearly displays the indicia at night. The sign is powered by a battery, and controlled by a control circuit in response to inputs from a solar panel used to recharge the battery, a photocell used to detect appropriate light conditions to illuminate the internal light, and a timer to turn off the light. The real estate sign is attached to a mounting bracket, which, in turn, is anchored to the parcel of real estate. The sign is locked to the mounting bracket to prevent theft and to rigidly maintain the sign and position.

U.S. Pat. No. 6,299,325 to Cathel discloses an illuminating mailbox address indication device includes a generally rectangular shaped housing mounted on a top portion of a mailbox. Enclosed within the housing is a light means powered by a set of batteries which are rechargeably energized by a solar cell mounted upon the housing. A photosensitive cell operates a switch to permit the light means to illuminate when a predetermined threshold has been exceeded relevant to the amount of ambient light present around the mailbox. The housing walls are translucent and further include indica stenciled thereupon which represent the address of the property associated with the mailbox.

U.S. Pat. No. 6,402,338 to Mitzel, et al. describes an enclosure illumination system mounted on an enclosure. The enclosure illumination system includes a solar battery, a light element, and a motion sensor. When external light impinges upon the solar battery, light is prevented from actuating. When the solar battery is not exposed to external light, for example, at nighttime, light may be actuated by signals transmitted by the sensor.

U.S. Pat. No. 6,629,766 to Cathel teaches an illuminating mailbox address indication device which includes a generally rectangular shaped housing mounted on a top portion of a mailbox wherein at least one longitudinal wall is removable. Enclosed within the housing is a light means powered by at least one rechargeable battery energized by a solar cell mounted upon the housing top wall in a recess formed therein. A photosensitive cell operates a switch to permit the light means to illuminate when a pre-determined threshold has been exceeded relevant to the amount of ambient light present around the mailbox (i.e., at night). At least one of the longitudinal housing side walls is translucent and further supports indica stenciled thereupon which represents the address of the property associated with the mailbox.

The foregoing patents reflect the current state of the art of which the present inventor is aware. Reference to, and discussion of, these patents is intended to aid in discharging Applicant's acknowledged duty of candor in disclosing information that may be relevant to the examination of claims to the present invention. However, it is respectfully submitted that none of the above-indicated patents disclose, teach, suggest, show, or otherwise render obvious, either singly or when considered in combination, the invention described and claimed herein.

SUMMARY OF THE INVENTION

The present invention provides an illuminated dispenser and display apparatus for advertisements. The preferred embodiment of the invention comprises a solar powered display box for real estate flyers or brochures. The display box has a back panel, two side panels, a transparent front panel, a bottom, and a hinged lid or top panel so that a person can lift the lid open and remove a brochure. The bottom may include one or more gaps or drain holes to eliminate water.

An internal bright white LED illuminates the front panel and the contents of the box. Power is supplied by an internal rechargeable battery, recharged by a solar panel mounted on the top of the hinged lid. A photo sensor activates the LED during low light conditions. Appropriate circuitry interconnects all of the components. The lid may be adjustable to optimize the angle of the solar panel relative to the sun.

In one version of this embodiment, the lid holds the LED, the electronics, the battery, the solar panel, the sensor, and the on/off switch. This version is well suited for retrofit installation on a variety of existing brochure boxes. In an alternate version, only the solar panel and sensor are in the lid, and the rest of the components are located in the box. This version makes the lid lighter and easier to open, and has a more streamlined look.

The box is designed for real estate flyers but can also be used in parks or other areas, for other types of brochures and/or advertising or announcement flyers.

The primary objective of the invention is to provide a solar powered brochure box (flyer encasement) using solar powered bright white LED lamps that illuminate the boxes front panel and its contents. The brochure box can display its contents where there is no power available, and the bright white LED lamps provides advantages over other conventional light by requiring low voltage, giving off little or no heat and having a life span of over 100,000 hours.

Another advantage of the lighted flyer box invention is the ability for a person to view the box contents from a distance through the transparent front, instead of going directly to the container and opening it up. This allows a person to just walk or drive by the sign/system without wasting time, and prevents inconvenience during inclement weather, when the box content is empty.

An optional feature provides the inside wall of the back panel with one or a plurality of shelves or detents to accommodate information-bearing cards, such as business cards. The detents may be arranged on the back panel so that two, three, or more cards may be displayed, e.g., the business card of the real estate sales agent, a card bearing succinct information about the property (e.g. "3Br/2Ba"), a card bearing the contact phone number, the business card of a mortgage broker, etc. In this manner, even if all of the original brochures have been dispensed and the display box is otherwise empty, a customer is still provided with the basic information about the property, and the contact information.

It is therefore an object of the present invention to provide new and improved illuminated dispensers and displays for advertisements.

Other novel features which are characteristic of the invention, as to organization and method of operation, together with further objects and advantages thereof will be better understood from the following description considered in connection with the accompanying drawings, in which preferred embodiments of the invention are illustrated by way of example. It is to be expressly understood, however, that the drawings are for illustration and description only and are not intended as a definition of the limits of the invention. The various features of novelty which characterize the invention are pointed out with particularity in the claims annexed to and forming part of this disclosure. The invention resides not in any one of these features taken alone, but rather in the particular combination of all of its structures for the functions specified.

There has thus been broadly outlined the more important features of the invention in order that the detailed description thereof that follows may be better understood, and in order that the present contribution to the art may be better appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of this application, which is measured by the claims, nor is it intended to be limiting as to the scope of the invention in any way.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

BRIEF DESCRIPTION OF THE DRAWINGS

The invention will be better understood and objects other than those set forth above will become apparent when consideration is given to the following detailed description thereof. Such description makes reference to the annexed drawings, wherein.

DETAILED DESCRIPTION OF THE INVENTION

Figure 1:
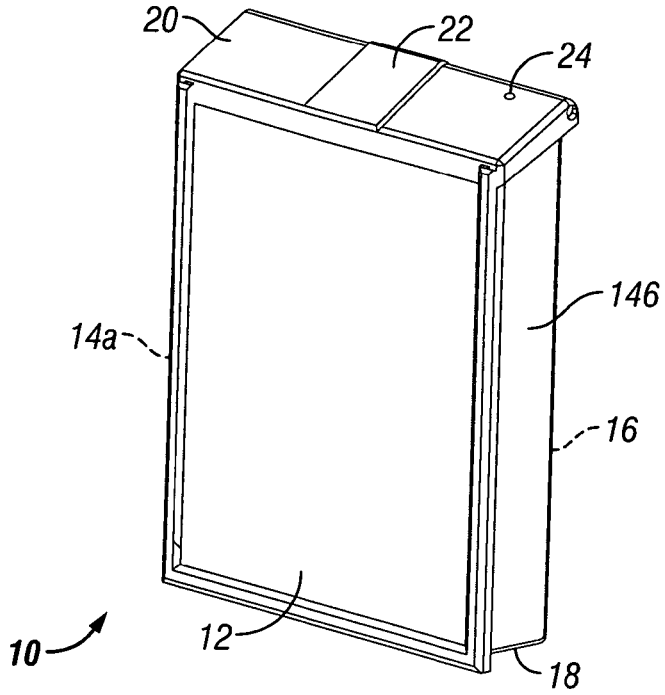
FIG. 1 is a front perspective view of a dispenser and display apparatus of this invention, with the lid closed.

Referring to the drawing figures, wherein like reference numerals refer to like components in the various views, there is illustrated therein a new and improved illuminated dispenser and display for advertisements, generally denominated 10 herein.

FIG. 1 is a front perspective view of a dispenser and display apparatus 10, illustrating a transparent front panel 12, a pair of side panels 14*a*, 14*b*, a back panel 16, a bottom 18, and a top panel or lid 20 in its closed position. Lid 20 preferably bears solar panel 22 and sensor 24.

Figure 2:
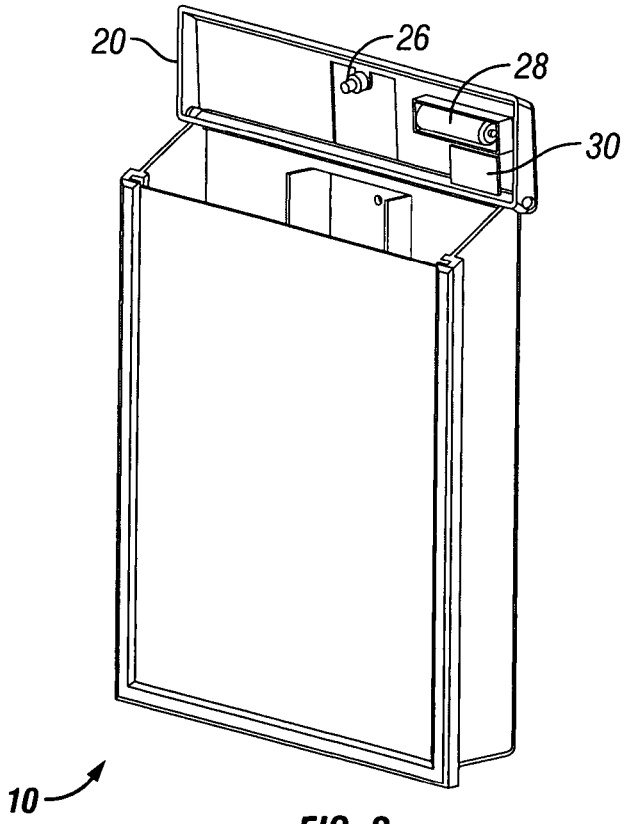
FIG. 2 is a front perspective view of a dispenser and display apparatus of this invention, with the lid open.

FIG. 2 is a front perspective view of the dispenser 10 with the lid 20 open, revealing an LED 26, rechargeable battery 28, and switch/electronics 30. These components are connected together to energize the LED from the battery at night when the sensor detects darkness, and to charge the rechargeable battery with the solar panel during the day, all as is well known in the art.

Figure 3:
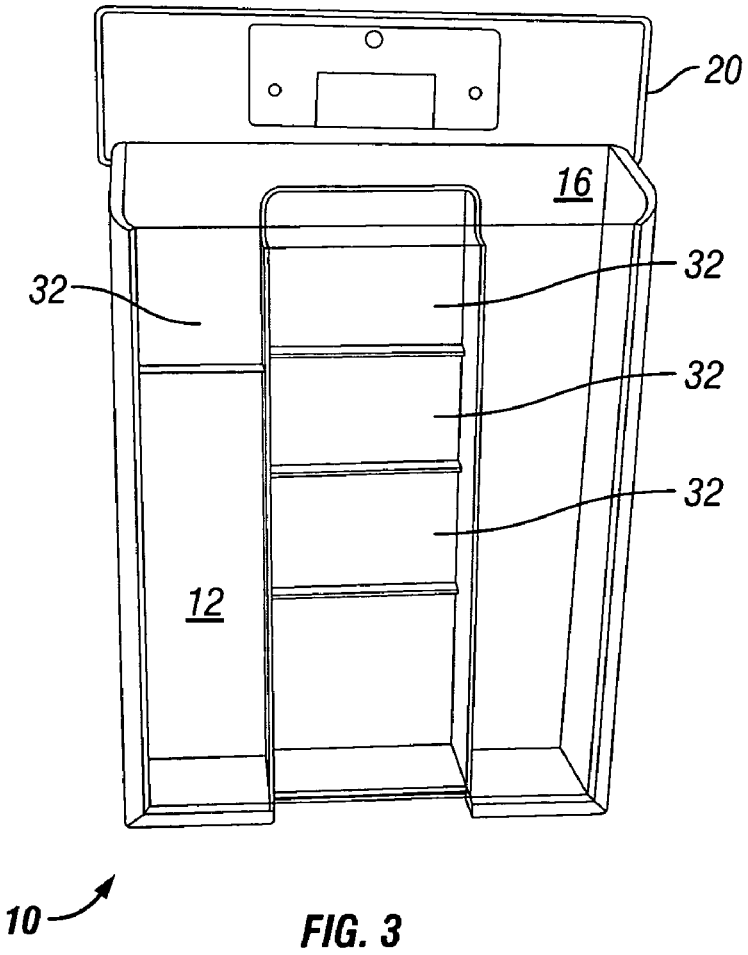
FIG. 3 is a front elevation view of the dispenser and display apparatus of this invention with the lid open and all of the brochures dispensed, revealing the inside wall of the back panel with its plurality of detents to accommodate informational cards.

FIG. 3 is a front elevation view of the dispenser 10 with the lid 20 open and all of the brochures dispensed, revealing the inside wall of the back panel 16 with a plurality of detents 32 to accommodate informational cards.

Accordingly, the invention may be characterized as a dispenser and display apparatus for advertisements comprising a box including a back panel, two side panels, a transparent front panel, a bottom, and a hinged lid, together defining an interior volume; a solar panel and a photosensor mounted on the lid; a light source mounted on the lid and adapted to illuminate the front panel and the interior volume when energized; a rechargeable battery; circuitry interconnecting the solar panel, photosensor, light source and battery, wherein the light source is energized during low light conditions to illuminate the front panel and the interior volume, and the rechargeable battery is charged by the solar panel during daylight conditions. Optionally, the rechargeable battery and the circuitry are mounted on the lid, and the back panel includes an inside wall bearing a plurality of detents to accommodate information-bearing cards.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed is:

1. A dispenser and display apparatus for advertisements, said apparatus comprising:

a box including a back panel, two side panels, a transparent front panel, a bottom, and a hinged lid, together defining an interior volume to accommodate a plurality of brochures accessible by said hinged lid, said back panel including an inside wall bearing detents to accommodate at least one information-bearing card;

a solar panel and a photosensor mounted on said lid;

a light source mounted on said lid and adapted to illuminate said front panel and said interior volume when energized;

a rechargeable battery; and circuitry interconnecting said solar panel, photosensor, light source and battery, wherein said light source is energized during low light conditions to illuminate said front panel and said interior volume, and said rechargeable battery is charged by said solar panel during daylight conditions, and wherein when the plurality of brochures have been dispensed from said interior volume, said inside wall bearing detents to accommodate at least one information-bearing card is visible through said transparent front panel.

2. The dispenser and display apparatus of claim 1 wherein said rechargeable battery and said circuitry are mounted on said lid.

3. The dispenser and display apparatus of claim 1 wherein said light source comprises an LED.

* * * * *